US005772458A

United States Patent [19]

Soes

[11] Patent Number: 5,772,458

[45] Date of Patent: Jun. 30, 1998

[54] ELECTRICAL PLUG COMPRISING TWO HALVES

[75] Inventor: Lucas Soes, Rosmalen, Netherlands

[73] Assignee: The Whitaker Corporation, Wilmington, Del.

[21] Appl. No.: 851,595

[22] Filed: May 5, 1997

[30] Foreign Application Priority Data

May 20, 1996 [NL] Netherlands ..... 196 20 177.2

[51] Int. Cl.[6] ..... H01R 13/62

[52] U.S. Cl. ..... 439/310

[58] Field of Search ..... 439/310, 180

[56] References Cited

U.S. PATENT DOCUMENTS

| | | | |
|---|---|---|---|
| 3,933,406 | 1/1976 | Cameron et al. | 439/358 |
| 4,026,624 | 5/1977 | Boag | 439/357 |
| 4,272,145 | 6/1981 | LaDuke | 439/358 |
| 4,273,403 | 6/1981 | Cairns | 439/345 |
| 4,602,831 | 7/1986 | Lockard | 439/108 |
| 4,828,510 | 5/1989 | Muzslay | 439/352 |
| 4,900,263 | 2/1990 | Manassero et al. | 439/358 |
| 4,915,643 | 4/1990 | Samejima et al. | 439/357 |
| 4,925,398 | 5/1990 | Samejima et al. | 439/357 |
| 5,004,431 | 4/1991 | Previato et al. | 439/358 |
| 5,314,347 | 5/1994 | Colleran et al. | 439/350 |
| 5,376,014 | 12/1994 | Sumida | 439/310 |

OTHER PUBLICATIONS

Copy of German Search Report.

*Primary Examiner*—Neil Abrams
*Assistant Examiner*—T. C. Patel
*Attorney, Agent, or Firm*—Driscoll Nina

[57] ABSTRACT

An electrical plug is described, which joins together automatically from a specific position, the electrical plug consisting of two plug halves, the first plug half having at least one first electric contact and a first housing, and the second plug half having at least one second contact, which is complementary to the first contact, and a second housing, the first housing having two part-housings which are movable relative to one another in the plug-in direction, and between which a spring in a prestressed state is arranged in such a way that the part-housings can be moved towards one another counter to the spring force, the first part-housing on the plug-in face side bearing the first contact and having at least one spring arm, the second housing having at least one stop in such a way that the spring arm runs against the said stop when the two plug halves are connected. The second part-housing has at least one cam which is arranged in such a way that the cam moves the spring arm away from the stop when the first part-housing and the second part-housing are pushed together, and that the first part-housing, which is then freely movable, is inserted automatically into the second plug half by the force of the spring.

5 Claims, 1 Drawing Sheet

ELECTRICAL PLUG COMPRISING TWO HALVES

BACKGROUND OF THE INVENTION

1. Field of the Invention

The invention relates to an electric plug comprising two plug halves.

2. Description of the Prior Art

In many plug applications, it is necessary to secure complete mating of two connector halves. This can be achieved, for example, in that the plug has to be inserted only up to a specific state, and the plug-in operation is then completed automatically.

SUMMARY OF THE INVENTION

The object of the invention is to specify such a plug, in which the plug-in operation is completed automatically from a specific position.

The object is achieved by an electric plug comprising two plug halves, the first plug half having at least one first electric contact and a first housing, and the second plug half having at least one second contact, which is complementary to the first contact, and a second housing, the first housing comprising two part housings which are movable relative to one another in the plug-in direction, and between which a spring in a prestressed state is arranged in such a way that the part-housings can be moved towards one another counter to the spring force, the first part-housing on the plug-in face side bearing the first contact and having at least one spring arm, the second housing having at least one stop in such a way that the spring arm runs against the said stop when the two plug halves are connected, and the second part-housing having at least one cam which is arranged in such a way that the cam moves the spring arm away from the stop when the first part-housing and the second part-housing are pushed together, and that the first part-housing, which is then freely movable, is inserted automatically into the second plug half by the force of the spring.

It is particularly advantageous for the spring arm and correspondingly the cams to be arranged on opposite sides of the first and second part-housing respectively. This achieves a particularly good distribution of force and thus uniform plug insertion.

It is furthermore advantageous for secure plug insertion to be achieved. If the spring is inserted in a prestressed state between the housing parts of the first housing, this ensures secure plug insertion, even in the case of an increased plug-in force.

DETAILED DESCRIPTION OF THE PREFERRED EMBODIMENT

Figures 1, 2, 3:
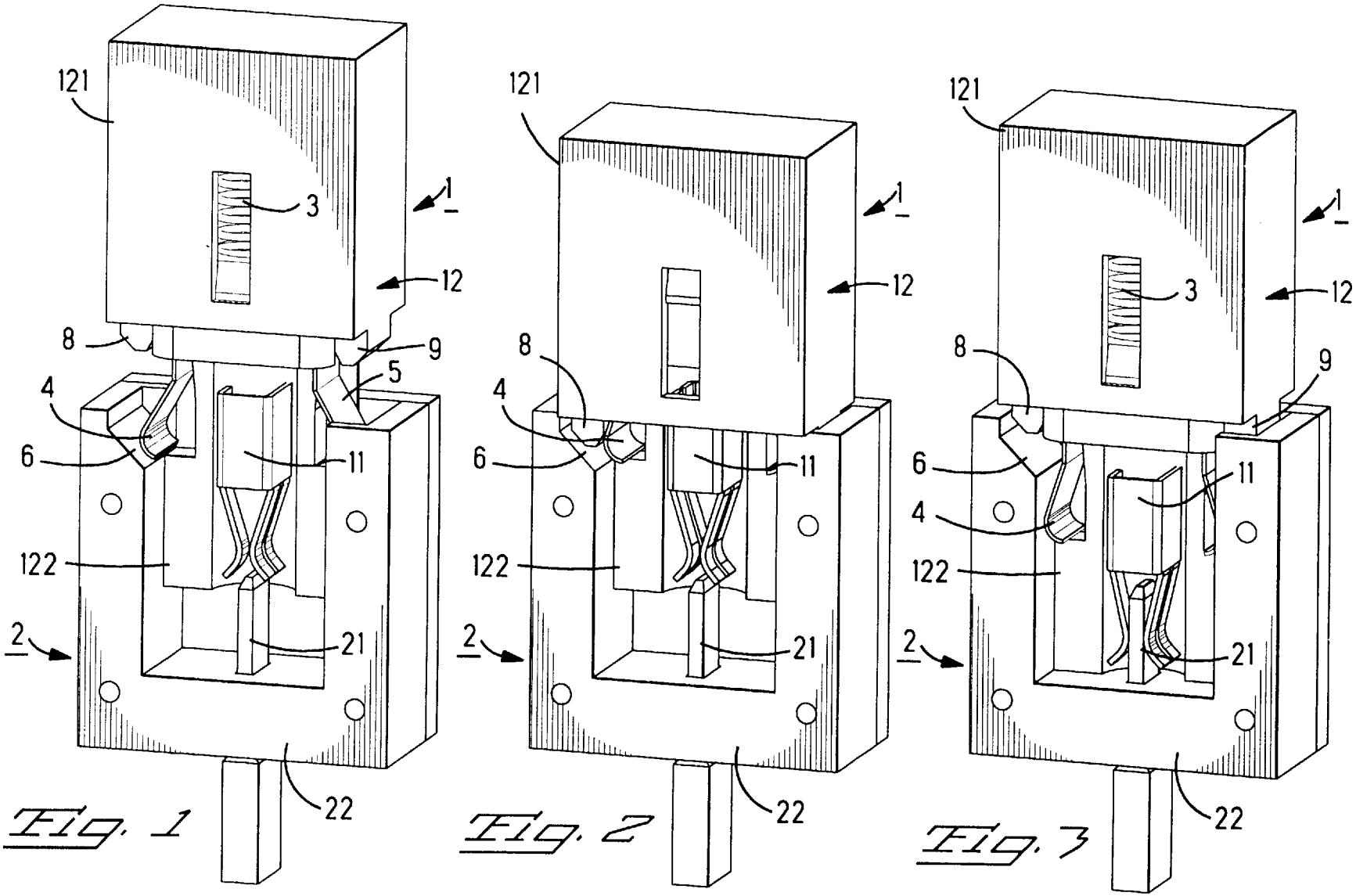
FIG. 1 shows an electric plug connection in a first position during the joining-together operation.
FIG. 2 shows the electric plug of FIG. 1 in a second position in the joining-together operation.
FIG. 3 shows the electric plug of FIGS. 1 and 2 in the joined-together state.

FIG. 1 illustrates the electric plug comprising a first plug half 1 and a second plug half 2. The second plug half 2 has at least one second electric contact 21 in a second housing 22. The electric contact 21 may, for example, be a contact pin, and the second housing 22 may be produced from an insulating material. On the plug-in face side, the second housing 22 has a kind of insertion funnel to facilitate the insertion of the complementary first plug half 1. This insertion funnel has slopes fitted as stop 6 on opposite sides.

The first plug half 1 is constructed as follows. A first electric contact 11, for example a socket contact, is provided. Furthermore, the first plug half 1 has a first housing 12. The first housing 12 comprises a first housing part 122 and a second housing part 121. The first electric contact 11 is fastened to the first housing part 122. The first housing part 122 is displaceable relative to the second housing part 121 in the plug-in direction. It is particularly advantageous if the first housing part 122 can be pushed into the second housing part 121.

Arranged between the two housing parts 121,122 is a spring 3 in a prestressed state (FIG. 1), which is compressed when the two housing parts 121, 122 are pushed together (FIG. 2). The housing parts 121, 122 are thus pushed together counter to the force of the spring 3.

The first housing part 122 has spring arms 4 and 5 on opposite sides, which spring arms are designed in such a way that, when the first plug half 1 is initially joined together with the second plug half 2, the spring arms 4, 5 run against the stop 6. Further insertion of the first housing part 122 into the second housing 22 is not possible and the spring 3 is then compressed by continued insertion pressure on the second housing part 121 in the plug-in direction.

Cams 8, 9 are arranged on opposite sides of the second housing part 121. By continued insertion pressure on the second housing part 121, the cams 8, 9 are moved towards the spring arms 4, 5, as illustrated in FIG. 2, and move the spring arms in such a way that they no longer run against the stop 6. The first housing part 122 thus becomes freely movable. By the force of the compressed spring 3, the first housing part 122 with the first electric contact 11 then continues to be moved in the plug-in direction.

FIG. 3 then shows the state with the plug 12 completely inserted, in which the first electric contact 11 has made electric contact with the second electric contact 21. The spring 3 in the first housing 12 is in the initial prestressed state again.

The plug-in operation is completed automatically. Complete mating is always securely achieved. It is particularly advantageous for the spring arm and correspondingly the cams to be arranged on opposite sides of the first and second part-housing respectively. This achieves a particularly good distribution of force and thus uniform plug insertion. It is furthermore advantageous for secure plug insertion to be achieved. If the spring is inserted in a prestressed state between the housing parts of the first housing, this ensures secure plug insertion, even in the case of an increased plug-in force.

I/We claim:

1. An electrical plug comprising a first and a second plug half, the first plug half having at least one first electric contact and a first housing, and the second plug half having at least one second contact, which is complementary to the first contact, and a second housing, the first housing having two part-housings which are movable relative to one another in the plug-in direction, and between which a spring is arranged in such a way that the part-housings can be moved towards one another counter to the spring force, the first part-housing bearing the first contact and having at least one spring arm, the second housing having at least one stop positioned in such a way that the spring arm runs against the said stop when the two plug halves are initially connected thereby preventing further insertion, the second part-housing having at least one cam which is arranged in such a way that the cam moves the spring arm away from the stop when the first part-housing and the second part-housing are pushed together during insertion, which loads the spring, and that the first part-housing, which then becomes freely movable, is inserted automatically into the second plug half by the force of the spring.

2. The electrical plug according to claim 1, wherein the first electric contact is a socket contact, and the second electric contact is a pin contact.

3. The electrical plug according to claim 1, wherein at least one spring arm is arranged in each case on at least two opposite sides of the first part-housing.

4. The electrical plug according to claim 3, wherein at least one cam is provided in each case on at least two opposite sides of the second part-housing.

5. The electrical plug according to claim 1, wherein the spring is arranged in a prestressed state between the part-housings.

* * * * *